US007328858B2

(12) United States Patent
Bosio

(10) Patent No.: US 7,328,858 B2
(45) **Date of Patent: *Feb. 12, 2008**

(54) SHOWER HEAD FOR KITCHEN SINK

(75) Inventor: Orlando Bosio, Casaloldo (IT)

(73) Assignee: AMFAG S.p.A., Cadtel Goffredo (IT)

( * ) Notice: Subject to any disclaimer, the term of this patent is extended or adjusted under 35 U.S.C. 154(b) by 257 days.

This patent is subject to a terminal disclaimer.

(21) Appl. No.: 10/984,808

(22) Filed: Nov. 10, 2004

(65) Prior Publication Data

US 2005/0103896 A1 May 19, 2005

(30) Foreign Application Priority Data

Nov. 14, 2003 (IT) ..... MN2003A0043

(51) Int. Cl.
*A62C 31/00* (2006.01)

(52) U.S. Cl. ..... 239/444; 239/583; 239/443; 239/449; 403/348; 403/353

(58) Field of Classification Search ..... 239/447, 239/449, 583, 448, 445, 443, 436, 579; 403/348, 403/349, 350, 353
See application file for complete search history.

(56) References Cited

U.S. PATENT DOCUMENTS 5,145,114 A * 9/1992 Monch ..... 239/126
5,707,011 A * 1/1998 Bosio ..... 239/447
5,730,362 A * 3/1998 Cordes ..... 239/123
5,918,816 A * 7/1999 Huber ..... 239/391
6,045,062 A * 4/2000 Bosio ..... 239/443
6,085,790 A 7/2000 Humpert et al.
6,151,729 A * 11/2000 Yean ..... 4/675
6,217,248 B1 * 4/2001 Reiff ..... 403/24
6,722,807 B1 * 4/2004 Cornet et al. ..... 403/2

FOREIGN PATENT DOCUMENTS

EP 0 659 490 6/1995
WO 01/23096 4/2001

* cited by examiner

*Primary Examiner*—Kevin Shaver
*Assistant Examiner*—Trevor McGraw
(74) *Attorney, Agent, or Firm*—Modiano & Associati; Albert Josif; Daniel J. O'Byrne

(57) ABSTRACT

A shower head for a kitchen sink, comprising a first insert and a second insert for water conveyance, the second insert being provided with elements for coupling to the enclosure, which comprise at least one tab that is adapted to enter, as a consequence of motion in an axial direction, a receptacle provided in the enclosure in order to lock the insert upon rotation about its own axis, rotation in the opposite direction being prevented by the coupling with the first insert.

6 Claims, 6 Drawing Sheets

SHOWER HEAD FOR KITCHEN SINK

The present invention relates to a shower head for kitchen sink.

BACKGROUND OF THE INVENTION

Shower heads for supplying water to kitchen sinks are known, which comprise an outer enclosure shaped so as to define a tubular portion that is open at one end and is connected, at the other end, to a head-shaped portion; such enclosure contains water conveyance means adapted to prevent all contact of the water with the enclosure, and a device is also provided that is operated by the user in order to switch the path of the water from a central jet to a peripheral jet and vice versa.

SUMMARY OF THE INVENTION

Prior Patents by the same Applicant disclose a shower head of this kind, but continuing research has allowed to devise the present invention, which has the aim of providing a shower head that is particularly simple and safe in operation in the field of an extreme miniaturization.

This aim and other objects of the present invention are achieved by a shower head for kitchen sink having the features described in the appended claims.

BRIEF DESCRIPTION OF THE DRAWINGS

Further characteristics and advantages of the present invention will become better apparent from the description of a preferred but not exclusive embodiment of the shower head for kitchen sink according to the invention, illustrated by way of non-limiting example in the accompanying drawings, wherein.

DESCRIPTION OF THE PREFERRED EMBODIMENTS

Figure 1:
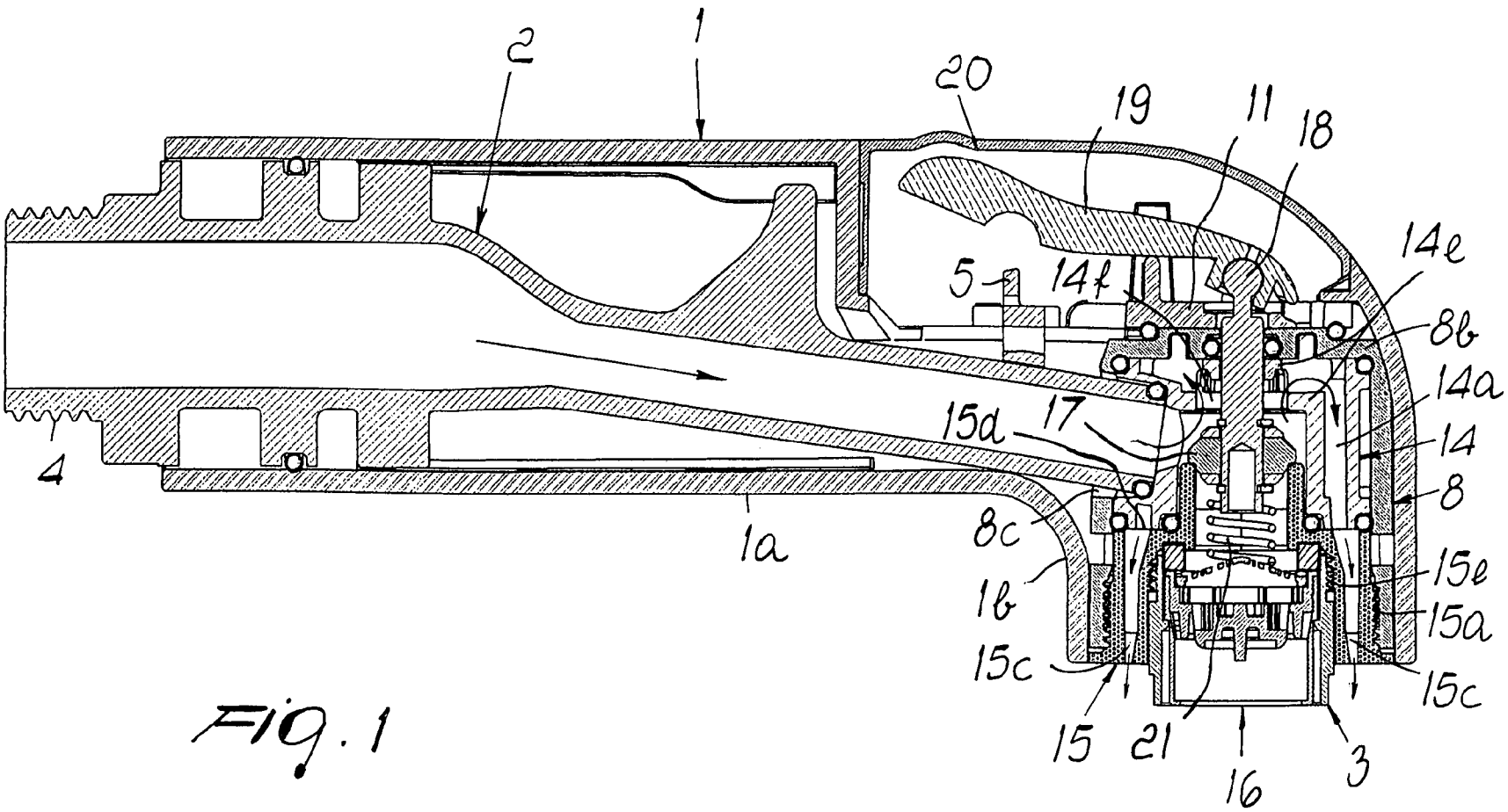
FIGS. 1 and 2 are longitudinal sectional views of the shower head according to the invention, respectively in the peripheral-jet position and in the central-jet position.

With reference to the figures, reference numeral 1 generally designates an outer enclosure of a shower head, which is shaped so as to define a tubular portion 1*a*, which is connected to a head-shaped portion 1*b* and is designed to contain water conveyance means, which comprise a device for switching the path of the water from a central jet to a peripheral jet and vice versa.

Such conveyance means are adapted to prevent any contact of the water with the outer enclosure and comprise a first elongated insert, generally designated by the reference numeral 2, and a second cylindrical insert, generally designated by the reference numeral 3, both of which are designed to be locked to each other and contained respectively within the tubular portion 1*a* and within the head-shaped portion 1*b* of the outer enclosure.

Figure 2:
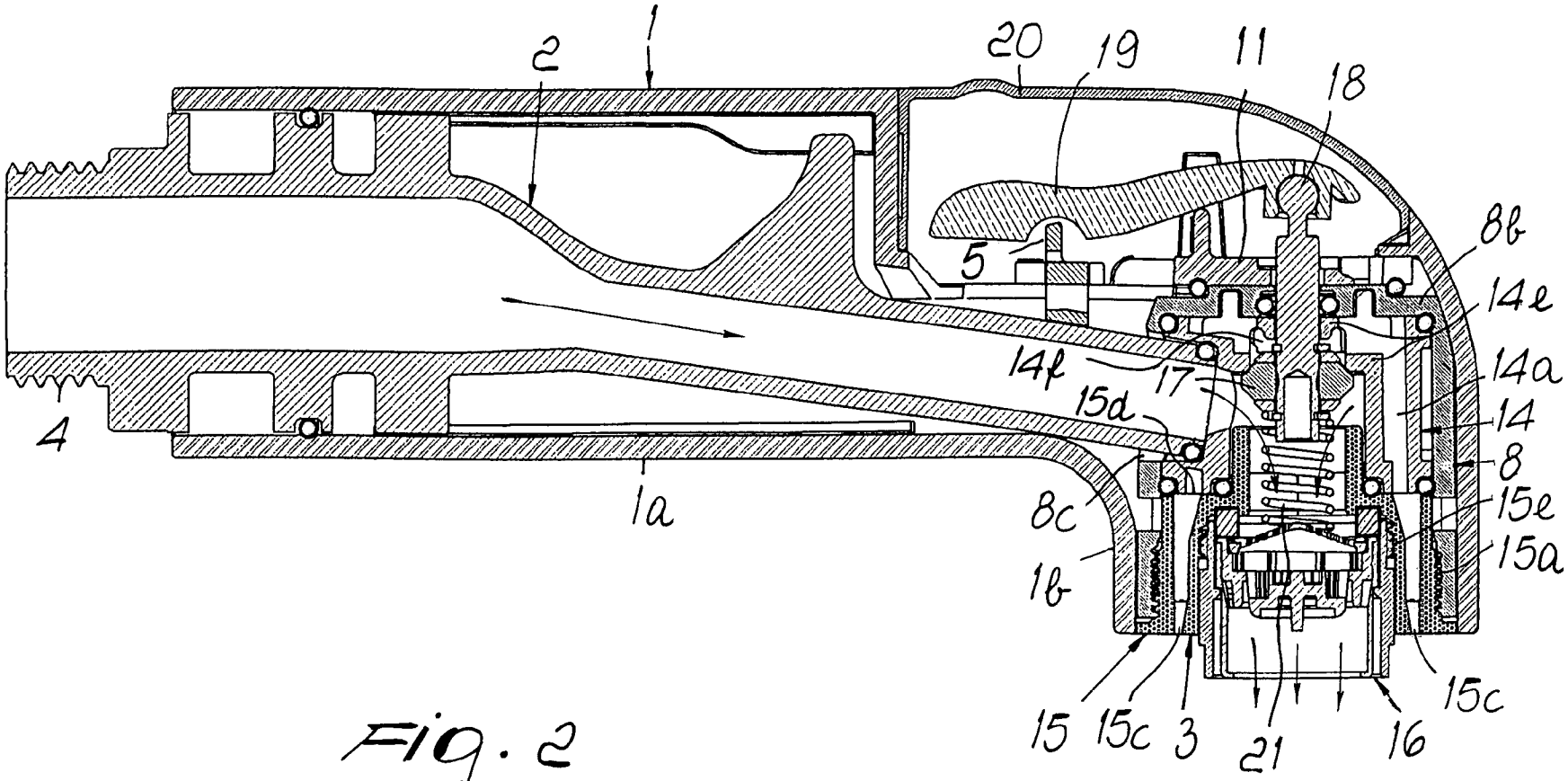
Figure 3:
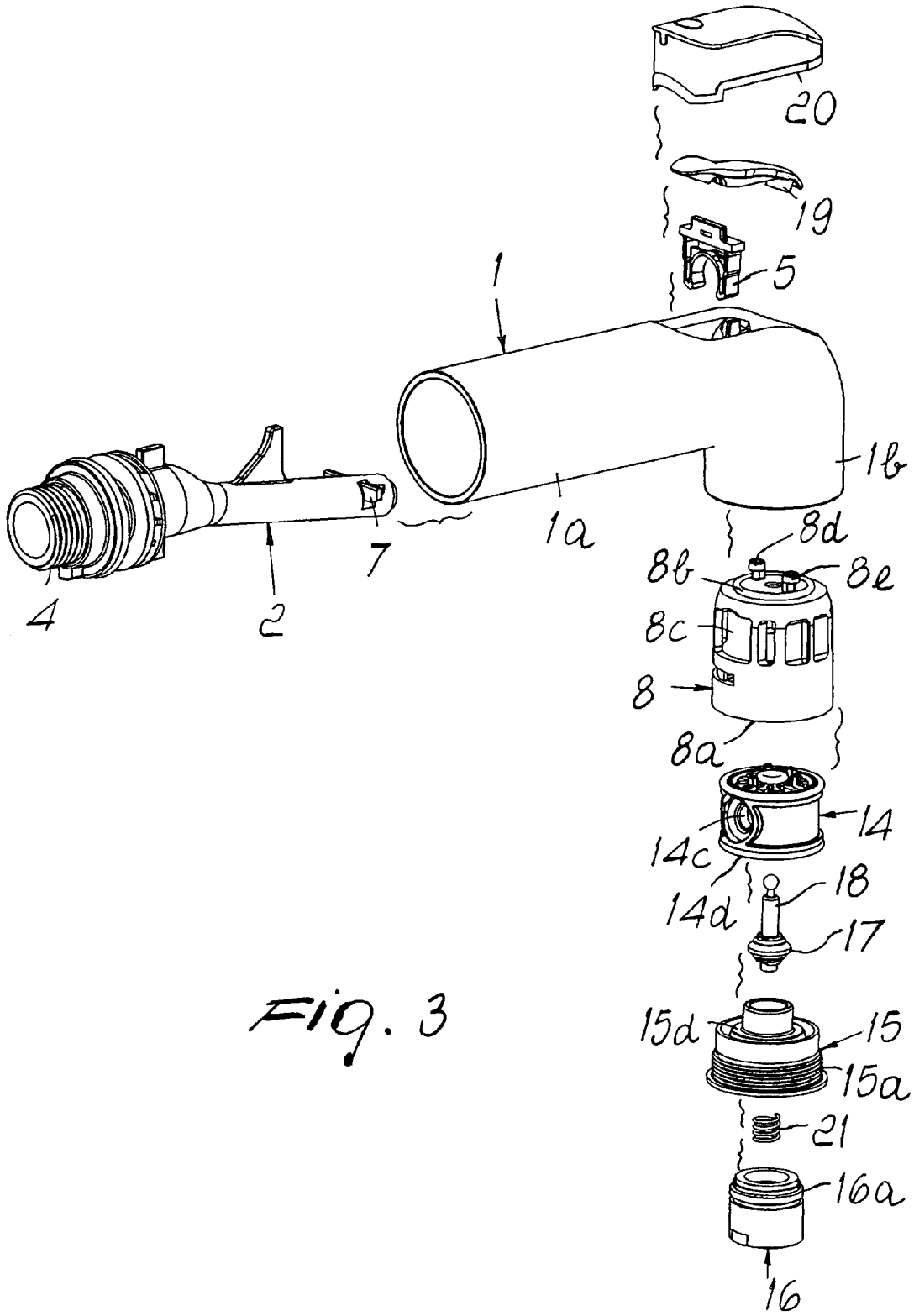
FIG. 3 is an exploded view of the shower head according to the invention.
Figure 4:
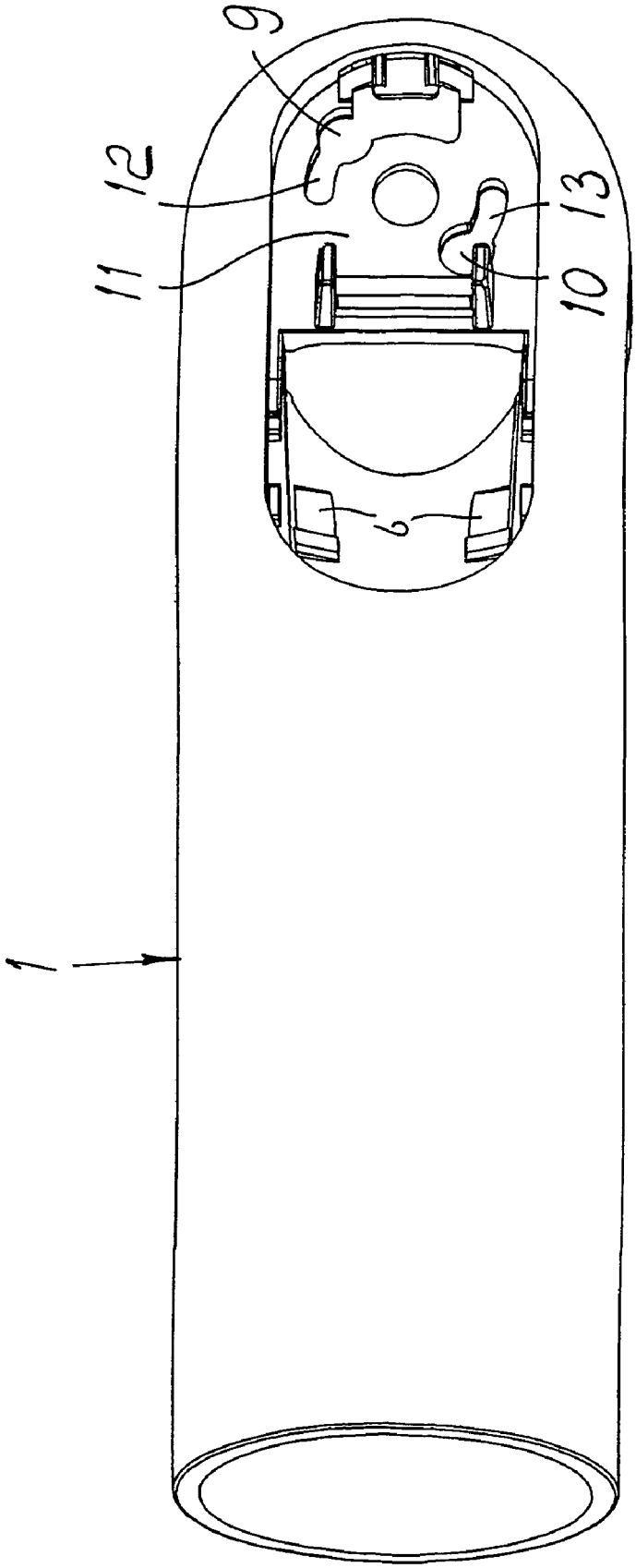
FIG. 4 is a top plan view of the outer enclosure.
Figure 5:
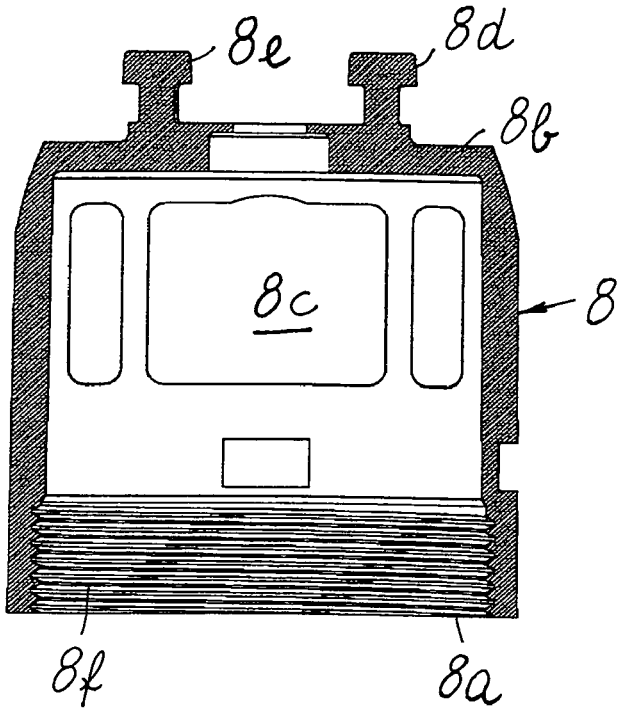
FIG. 5 is a sectional view of the cylindrical wall.
Figure 6:
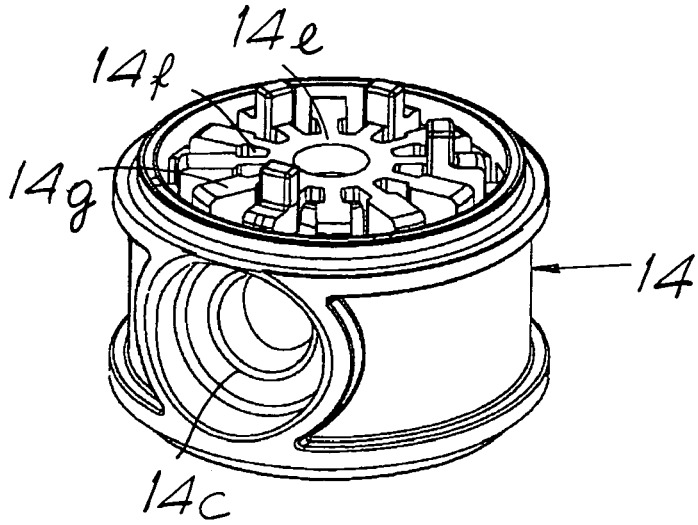
FIGS. 6 and 7 are two perspective views of the distribution unit.

The elongated insert 2 comprises, at the end that protrudes from the outer enclosure 1, a threaded portion 4 for connection to a water feed duct, and is provided with axial locking means so as to prevent its extraction once it has been associated with the cylindrical enclosure 3 as shown in FIGS. 1 and 2, such means being engaged on the outer enclosure 1.

Such means comprise in particular a U-shaped element 5, which is adapted to be associated with a receptacle 6 provided on the internal surface of the enclosure 1 by abutting against a protrusion 7 provided on the elongated insert 2.

The cylindrical insert 3 also is provided with axial locking means, which are adapted to ensure its stability in its receptacle, such means being described in greater detail hereinafter.

The cylindrical insert 3 is now described in detail and comprises a plurality of elements, which form a compact unit once they are assembled.

The first one of the plurality of elements is constituted by a cylindrical wall 8, which is open at an end 8*a* that is directed toward the outside of the outer enclosure 1 and is provided with a top or upper portion 8*b* at the other end; an opening 8*c* for insertion of the end of the elongated insert 2 is further arranged at the side wall.

The cylindrical wall 8 is provided with means for coupling to the outer enclosure 1, which comprise two mushroom-shaped tabs 8*d* and 8*e* that protrude from the top 8*b* and are adapted to enter, by moving in an axial direction, respective holes 9 and 10 provided in a flat ridge 11 that is rigidly coupled to said enclosure 1 in order to lock the cylindrical wall upon rotation thereof about its own axis, entering slots 12 and 13 formed as a continuation of said holes 9 and 10; rotation in an opposite direction is prevented by insertion of the elongated insert 2 in the opening 8*c*.

The second element of the cylindrical insert 3 is constituted by a distribution unit 14, which is accommodated within the cylindrical wall 8 and is kept in position in abutment against the top 8*b* thereof, as described in greater detail hereinafter.

The distribution unit is provided with channels, such as 14*a*, for the flow of water, which are comprised in a peripheral ring 14*b* provided with an opening 14*c* that is designed to be mated to the end of the elongated insert 2.

Figure 7:
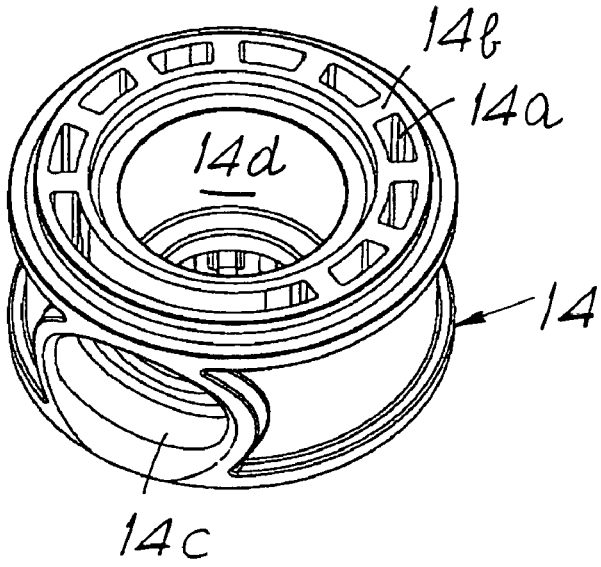
Figure 8:
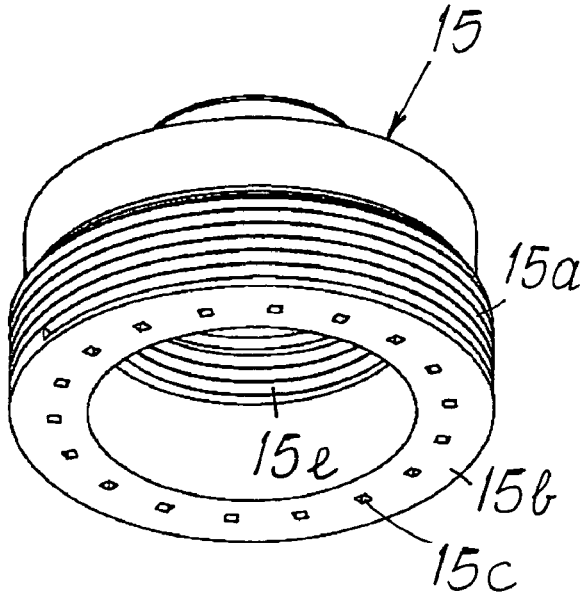
FIG. 8 is a perspective view of the annular element.

The portion of space that is comprised within the ring 14*b* is open at an end 14*d* that is directed toward the outside of the enclosure and is shown in FIG. 7, and has, at its other end, a cap 14*e*, which comprises water flow ports such as 14*f*; a plurality of ridges such as 14*g* ensure connection between the channels 14*a* and the ports 14*f*.

The third element of the cylindrical insert 3 is constituted by an annular element 15, which is associated by means of a thread 15*a* with the cylindrical wall 8 at the thread 8*f* of said cylindrical wall.

The annular element delimits a central portion of space, which is open and is comprised within the peripheral ring 15*b* provided with channels 15*c* for the flow of water, which are designed to be arranged as a continuation of the channels 14*a* provided in the distribution unit 14, and comprises a surface 15*d*, which is adapted to abut against the distribution unit in order to keep it in position in abutment against the top 8*b* of the cylindrical wall 8.

The annular element 15 is further provided with a thread 15*e*, which allows to assemble a diffuser 16, by means of a thread 16*a* thereof.

Finally, the reference numeral 17 designates a flow control element, which is associated with a rod 18, which is adapted to be operated by a user by means of a lever-type button 19, protected by a hood 20, in contrast with a spring 21 in order to switch the path of the water by moving between the position shown in FIG. 1 and the position shown in FIG. 2, providing respectively the peripheral-jet condition and the central-jet condition, as clearly shown by the arrows in the figures.

Suitable gaskets complete the shower head according to the invention, as shown in FIGS. 1 and 2.

The described invention is susceptible of numerous modifications and variations, all of which are within the scope of the appended claims; thus, for example, the outer enclosure may have any shape, with a consequent suitable shape of the conveyance means.

The insert designed to be contained within the head-shaped portion of the outer enclosure may have any shape, also in relation to the means for fixing to the outer enclosure, which may comprise at least one tab of any shape that protrudes in any position from the wall of said insert.

The insert designed to be contained in the tubular portion of the outer enclosure may also be locked in any manner and may have any configuration.

The disclosures in Italian Patent Application No. MN2003A000043 from which this application claims priority are incorporated herein by reference.

What is claimed is:

1. A shower head for kitchen sink, comprising an outer enclosure that is shaped so as to define a tubular portion that is open at one end and is connected, at the other end, to a head-shaped portion, and is adapted to contain water conveyance means adapted to prevent any contact of the water with said enclosure, said water conveyance means comprising a first insert and a second insert, which are locked to each other, said first insert being contained within the tubular portion of the enclosure and having, at an end that protrudes from said enclosure, means for coupling to a water supply duct, said second insert being contained within the head-shaped portion of the enclosure and comprising a switching device for switching a path of the water from a central jet to a peripheral jet and vice versa, said second insert comprising a cylindrical wall that is open at one end directed outwardly of said outer enclosure and that is provided with a top portion, said second insert further comprising a distribution unit arranged within said cylindrical wall and cooperating with said switching device, and said second insert further comprising an annular element abutting against said distribution unit to keep said distribution unit in abutment against said top portion of said cylindrical wall, said second insert being provided with means for coupling to the outer enclosure, which comprise at least one tab that is provided on said top portion of said cylindrical wall and that is adapted to enter, as a consequence of motion in an axial direction of said insert, a receptacle provided in said enclosure in order to lock the cylindrical wall of said second insert upon a first rotation thereof about its own axis, a second rotation of said second insert in an opposite direction with respect to said first rotation being prevented by the coupling of the first insert with said second insert, and said annular element being screwed to said cylindrical wall.

2. The shower head according to claim 1, wherein the first insert is provided with axial locking means engaged on the outer enclosure.

3. A shower head for kitchen sink, comprising an outer enclosure that is shaped so as to define a tubular portion that is open at one end and is connected, at the other end, to a head-shaped portion, and is adapted to contain water conveyance means adapted to prevent any contact of the water with said enclosure, said means in turn comprising a first insert and a second insert, which are locked to each other, said first insert being designed to be contained within the tubular portion of the enclosure and having, at an end that protrudes from said enclosure, means for coupling to a water supply duct, said second insert being designed to be contained within the head-shaped portion of the enclosure and comprising a device for switching a path of the water from a central jet to a peripheral jet and vice versa, said second insert being provided with means for coupling to the outer enclosure, which comprise at least one tab that is adapted to enter, as a consequence of motion in an axial direction of said insert, a receptacle provided in said enclosure in order to lock the insert upon rotation thereof about its own axis, rotation in an opposite direction being prevented by the coupling with the first insert, the first insert being provided with axial locking means, which comprise a U-shaped element that is adapted to be associated with a receptacle formed in the outer enclosure, abutting against a protrusion provided on said insert.

4. The shower head according to claim 3, wherein the second insert, which is designed to be contained within the head-shaped portion of the enclosure, comprises at least two mushroom-shaped tabs, which face a surface of said portion that is arranged opposite an outward opening thereof, said protrusions being adapted to enter, by moving in an axial direction, respective holes provided in a flat ridge that is rigidly coupled to said enclosure in order to lock said second insert upon rotation thereof about its own axis, entering slots formed as a continuation of said holes, rotation in an opposite direction being prevented by the coupling with the first insert.

5. A shower head for kitchen sink, comprising an outer enclosure that is shaped so as to define a tubular portion that is open at one end and is connected, at the other end, to a head-shaped portion, and is adapted to contain water conveyance means adapted to prevent any contact of the water with said enclosure, said means in turn comprising a first insert and a second insert, which are locked to each other, said first insert being designed to be contained within the tubular portion of the enclosure and having, at an end that protrudes from said enclosure, means for coupling to a water supply duct, said second insert being designed to be contained within the head-shaped portion of the enclosure and comprising a device for switching a path of the water from a central jet to a peripheral jet and vice versa, said second insert being provided with means for coupling to the outer enclosure, which comprise at least one tab that is adapted to enter, as a consequence of motion in an axial direction of said insert, a receptacle provided in said enclosure in order to lock the insert upon rotation thereof about its own axis, rotation in an opposite direction being prevented by the coupling with the first insert, the second insert, designed to be contained within the head-shaped portion of the enclosure, comprising:

a cylindrical wall, which is adapted to be accommodated within the head-shaped portion of the outer enclosure, is open at an end of said enclosure that is directed outwardly, and has a top at an other end, further comprising, at a cylindrical wall, an opening for insertion of the end of the first insert, said cylindrical wall being provided with means for coupling to the outer enclosure, which comprise at least two mushroom-shaped tabs, which protrude from the lid of said cylindrical wall and are adapted to enter, by moving in an axial direction, respective holes provided in a flat ridge that is rigidly coupled to said enclosure in order to lock the cylindrical wall upon rotation thereof about its own axis, entering slots formed as a continuation of said holes, rotation in an opposite direction being prevented by the coupling to the first insert;

a distribution unit, which is adapted to be accommodated within said cylindrical wall and is kept in position in abutment against its top and is provided with channels for the flow of water, which are open at both ends and are comprised within a peripheral annular ring, a portion of space comprised within said ring being open at an end that is directed toward the outside of the enclosure and being provided, at an other end, with a cap that comprises water flaw ports, a plurality of ridges being provided which are adapted to ensure connection between said ports and the channels comprised within the peripheral ring, a port designed to be mated to the end of the first insert being further provided at the cylindrical wall;

an annular element, which is associated with said cylindrical wall and is adapted to delimit an open central portion of space that is comprised in a peripheral ring provided with channels for the flow of water, which are adapted to be arranged as a continuation of the channels comprised in the peripheral ring of the distribution unit;

a flow control element, associated with a rod that is adapted to be operated by an operator by means of a button in contrast with a spring in order to provide switching of a path of the water from a central jet to a peripheral jet and vice versa by moving between two positions in contact respectively with the cap of the distribution unit and with an inlet of the central portion of space of the annular element.

6. The shower head according to claim 5, wherein the annular element is associated with the cylindrical wall by threading and comprises a surface that is adapted to abut against the distribution unit in order to keep said distribution unit in position in abutment against the top of said cylindrical wall.

* * * * *